US008926117B2

(12) United States Patent
Blanchette

(10) Patent No.: US 8,926,117 B2
(45) Date of Patent: Jan. 6, 2015

(54) PORTABLE ATTACHABLE ILLUMINATION DEVICE FOR BRUSHES

(75) Inventor: David Raymond Blanchette, Bradford, MA (US)

(73) Assignee: Brush Lite Innovations, LLC, Haverhill, MA (US)

( * ) Notice: Subject to any disclaimer, the term of this patent is extended or adjusted under 35 U.S.C. 154(b) by 132 days.

(21) Appl. No.: 13/466,896

(22) Filed: May 8, 2012

(65) Prior Publication Data

US 2013/0301251 A1 Nov. 14, 2013

(51) Int. Cl.
*F21V 33/00* (2006.01)
*B25B 23/18* (2006.01)

(52) U.S. Cl.
USPC ..... 362/109; 362/119; 362/91; 362/249.02; 439/135; 439/374; 15/106; 15/146; 15/257.2; 15/324

(58) Field of Classification Search
CPC ..... A64B 15/0036
USPC ..... 362/23.05, 23.07, 91, 109–120, 227, 362/234, 243, 247, 394, 457, 458, 473, 474, 362/807; 15/146, 151, 224, 257.2; 439/135, 439/374, 378, 380, 335
See application file for complete search history.

(56) References Cited

U.S. PATENT DOCUMENTS

| | | | | |
|---|---|---|---|---|
| 5,181,773 | A * | 1/1993 | Colvin | 362/488 |
| 5,684,378 | A * | 11/1997 | Furth et al. | 362/183 |
| 2007/0240275 | A1* | 10/2007 | Willenbring | 15/324 |
| 2012/0294470 | A1* | 11/2012 | Saltalamacchia | 381/334 |
| 2012/0324663 | A1* | 12/2012 | Fleischer | 15/106 |

* cited by examiner

*Primary Examiner* — Jong-Suk (James) Lee
*Assistant Examiner* — Zheng Song
(74) *Attorney, Agent, or Firm* — Ascentage Law, PLLC

(57) ABSTRACT

A portable attachable illumination device configured to slidably attach to and partially encompass a brush.

18 Claims, 5 Drawing Sheets

FIG. 2C

PORTABLE ATTACHABLE ILLUMINATION DEVICE FOR BRUSHES

COPYRIGHT STATEMENT

A portion of the disclosure of this patent application document contains material that is subject to copyright protection including the drawings. The copyright owner has no objection to the facsimile reproduction by anyone of the patent document or the patent disclosure as it appears in the Patent and Trademark Office file or records, but otherwise reserves all copyright rights whatsoever.

BACKGROUND OF THE INVENTION

1. Field of the Invention

The present application relates to the field of attachable lights. More specifically, the application relates to a portable light apparatus that may attach to paintbrushes and/or brushes used for other purposes.

2. Description of the Prior Art

When a painter is painting a wall or moldings, shadows may be created by many things, including: the painter's hand, light fixtures, and the architectural design of the space being painted. Additionally, painters encounter spaces where light is limited, impossible, or highly inconvenient. Further, other occupations use brushes in areas where light is desired, but where that light is also limited, impossible, or highly inconvenient, including: sculptors, scientists, archaeologists, and more. A need therefore exists to have a portable light source that provides adequate illumination and eliminates shadows when using a brush or similar device.

SUMMARY OF THE INVENTION

Illustrative embodiments of the present invention, shown in the drawings, are more fully described in the Detailed Description section. It is to be understood that there is no intention to limit the invention to the forms described in this Summary of the Invention or in the Detailed Description. One skilled in the art can recognize that there are numerous modifications, equivalents, and alternative constructions that fall within the spirit and scope of the invention as expressed in the claims.

The present invention may provide a portable illumination apparatus for a brush, also included is a method for providing a portable light source for a brush. One illustrative embodiment is an apparatus that slidably attaches to and partially encompasses a paintbrush. The removably (slidably) attachable portable illumination apparatus comprises: a body, a channel formed within the body that extends the length of the body and is configured to receive a portion of a brush, a plurality of luminaires positioned along one end of the body; and at least one power source located within the body that is electrically linked to the luminaires. In some embodiments one end of the apparatus may be configured to form a cavity large enough to house the luminaires. A cover or window may be formed over the cavity containing the luminaires and attach to the body. In some instances, the cover or window may be a lens.

Also disclosed herein is a method for providing a portable light source that can attach to a brush. The light source is provided by slidably attaching a portable illumination apparatus over a handle and ferrule portion of a brush and actuating a conductive tab that is extended into a channel formed within the apparatus and extends through the length of the portable illumination apparatus. By actuating the conductive tab, an electrical connection between a plurality of luminaries and a power source is created. These and other embodiments are described in more detail herein.

DETAILED DESCRIPTION OF THE PREFERRED EMBODIMENT

For years, consumers have used paintbrushes to coat an object, wall, decorative trim or something similar, with paint. Likewise, consumers have used brushes to clean delicate objects, sculptures, living spaces and more. Painting and cleaning does not always occur in areas having adequate lighting. Even in areas having adequate light, oftentimes the shapes of the work-piece or object being painted create shadows. In other situations a painter must distinguish a line between two similar looking colors or shades. A need therefore exists for a product that has a self-contained power source, automatic illumination features, provides adequate illumination for a working area, and has a uni-body design.

The present application seeks to provide a solution to the aforementioned problems by creating a portable illumination apparatus configured to removably or slidably attach to and partially encompass a portion of a brush. Additionally, contemplated herein is a method for illuminating a working area around a brush.

For purposes of this application, a luminaire may refer to, but is not limited to, any of a light emitting diode, a laser, an incandescent light, or other light source commonly used in the art. In addition, a detent may refer to, but is not limited to, any of a catch, spring-operated ball, cavity, hole, channel, opening, slit, or other mechanism configured for positioning and holding one mechanical component in relation to another in a manner such that the components may be released by applying a force to one or both of the components. In some instances the detent is configured to temporarily keep a component in a certain position relative to that of another, wherein the components may be released from each other by applying a force to one or both components.

The shank portion of a brush may refer to, but is not limited to, the straight, shaft-like portion of a brush, up and to connecting to the bristles. A ferrule generally holds the bristles or hairs onto the brush and is formed around the shank or handle portion of the brush.

Figure 1:
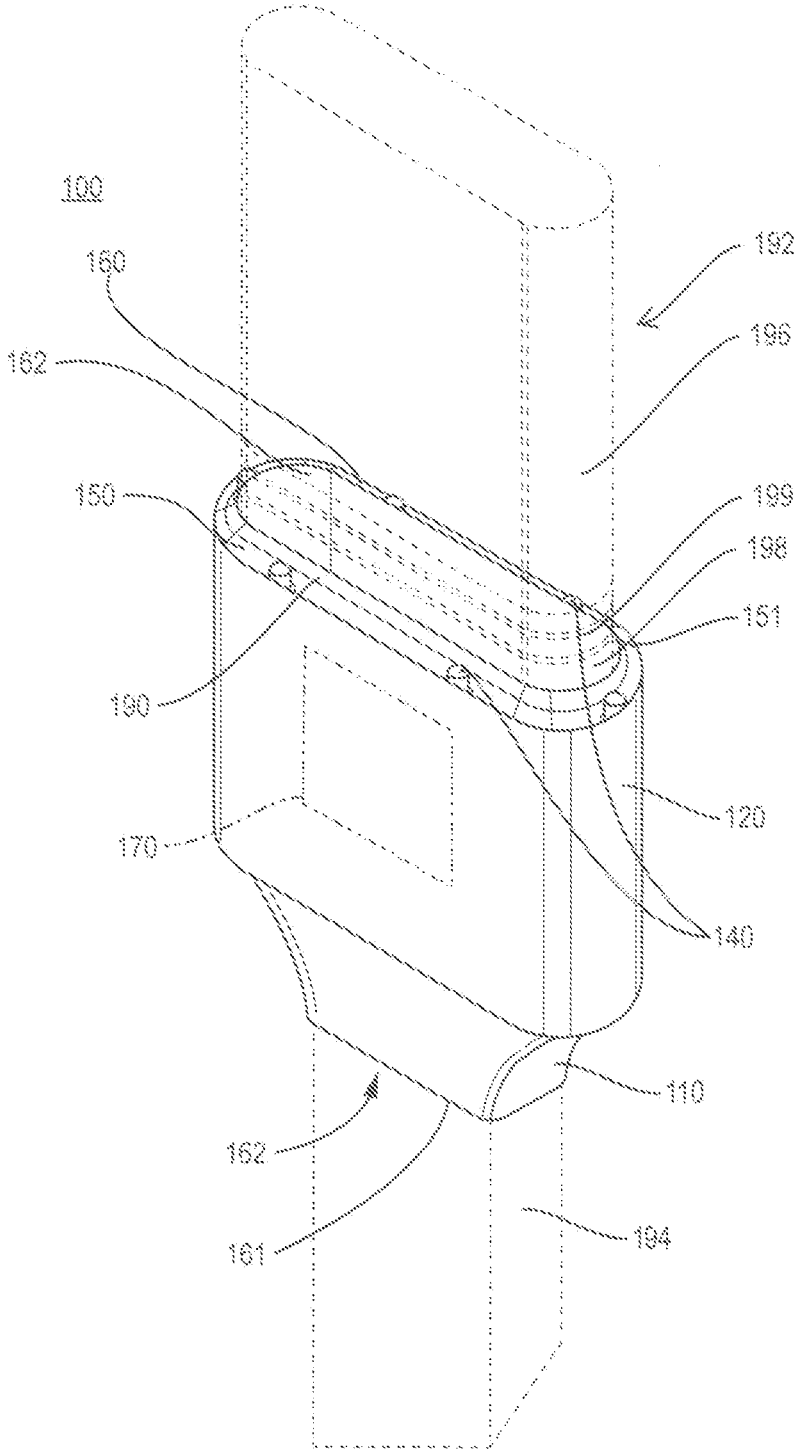
FIG. 1 illustrates a perspective view of a portable light apparatus with a straight top and non-tapered sides.

FIG. 1 illustrates an embodiment of a portable illuminating apparatus 100 having a body 120 with multiple openings or apertures contained therein (160,161). Wide opening 160, is located along the distal end of body 120, while a narrower opening 161, is located along the proximal end of body 120. As shown, the wide opening 160 is formed to fit over the bristle 196 and ferrule portion 198 of a portion of a brush 192, while the narrow opening 161 is formed to fit over the handle portion 194 of a brush 192 and generally does not fit over the bristle 196 and ferrule portion 198, as most brushes are wider at the ferrule portion of the brush than the rest of the handle portion of the brush. Internal channel 162 extends inside body 120 from the proximal opening 161 to the distal opening 160 and is conformed to slidably press-fit around the ferrule and shank portion of a paintbrush 192.

Internal channel 162 in some embodiments is formed to act as a detent to hold the apparatus 100 around the paintbrush 192 as described. The apparatus 100 may be released from the paintbrush by applying a force along a direction running along the shank portion of the brush. Apparatus 100 is configured to come off the same end of the paintbrush 192 as it was slid over. In some configurations internal channel 162 may contain ridges complementing similar ridges or protrusions 199 extending from various ferrules 198 of brushes and used to snap or press-fit into place around a brush 192.

Portable illuminating apparatus 100 further contains a plurality of luminaires 140 positioned along the distal end of the body. As shown in FIG. 1, luminaires 140 are placed on all four-sides of apparatus 100, but in some embodiments it may be sufficient to place luminaires on only two sides of apparatus 100. The number of luminaires required may depend on the individual attributes of each luminaire including emission angle, lumen output, and the current required to drive each. These luminaires may be LEDs, or other bulbs electrically connected to an internal power source such as a battery contained in the body portion of apparatus 100. For instance, FIG. 1 illustrates a potential removable cover 170 exposing an internal compartment containing a power source. It is contemplated that a removable cover 170 and internal compartment may be on either side or both sides of apparatus 100.

To enhance the angle and redirect more of the light emitted by each luminaire a reflective portion, strip, or surface 190 may be placed between each luminaire and an internal surface closer to internal channel 162 of the body 120 as shown in FIG. 1. In other embodiments it is contemplated that this reflective surface may also reside on or instead opposite of 190 between each luminaire 140 and the external surface (not labeled) of body 120. As shown on the distal end, a cavity 150 is formed to contain luminaires 140 and provide surfaces for reflective portion 190. The reflective surface may be used to direct light towards the bristles of a brush even when the bristles are bent, as well as away from the bristles to illuminate a working surface the brush may be applied to.

Cavity 150 may be contained entirely on the distal end of body 120 or may extend further towards the proximal end and generally stopping where contoured surface 110 reduces the width of the body 120 to conform with the shape of a paintbrush's handle. A window 151, as shown in this embodiment is placed over the opening of cavity 150. Window 151 may also have some optical power and act as a lens in some configurations to also focus and direct the light to form a desired illumination area on the working surface wherein a brush may be used as well as toward the bristle portion of each brush. This is particularly useful when a painter is cutting along a surface that may not be well lit.

Also as shown, the opening to cavity 150 and the window 151 may form a beveled edge extending from the plane containing the distal opening 160 into the main portion of body 120. This bevel may be rounded or angled in various configurations and may allow for an optimal cone of light to emit from cavity 150. Window 151 may be configured to be removably attached in some configurations where access to cavity 150 is desired.

It should be noted that body 120 as shown in FIG. 1, has two curved ends, but has straight sides extending down from the distal end to the proximal end until the contoured portion 110. In other embodiments body 120 may flare out slightly (or again form a bevel) extending from the proximal end to the distal end. The plane containing distal opening 160 is also substantially parallel to the plane containing proximal opening 161. Alternatively, and as described below distal opening 160 may be angled with respect to 161, which angle may run with the same angle as the ferrule and/or bristles of particular brush types. It should be noted, that not all brushes have ferrules, but the equivalent portion of the brush is to be within the scope of this application.

The body 120 of apparatus 100 may be of a single uni-body design as shown, but it is contemplated in other configurations and depending on various manufacturing techniques may be formed of multiple parts forming a uniform shape to adapt around a brush, while minimizing the amount of bulkiness and weight added to the brush. Various materials, such as fiber glass, plastic and other materials may be used to form the body 120. In one such configuration, a portable illumination device weighs less than eight ounces. It is contemplated that various lightweight materials may be used to reduce the weight of the portable attachable illuminating device to prevent it from interfering with the overall weight (and bulkiness) of a brush. Having a lightweight design is important so as to not impede the original use of the painter.

Other embodiments may not have a reflective portion, strip, or surface and may not include a lens. In some embodiments not having a lens and/or a reflective portion, strip, or surface, the luminaires may be secured to the surface of the apparatus. In such embodiments, it is contemplated that the luminaires may be angled in a manner so as to cast a cone of light towards the bristles of a brush. It is also contemplated that the luminaires may be angled so as to cast a cone of light into ambient areas surrounding the brush.

FIGS. 2A-E illustrate various views of an angled portable illumination device and its internal electrical assembly.

Figure 2A:
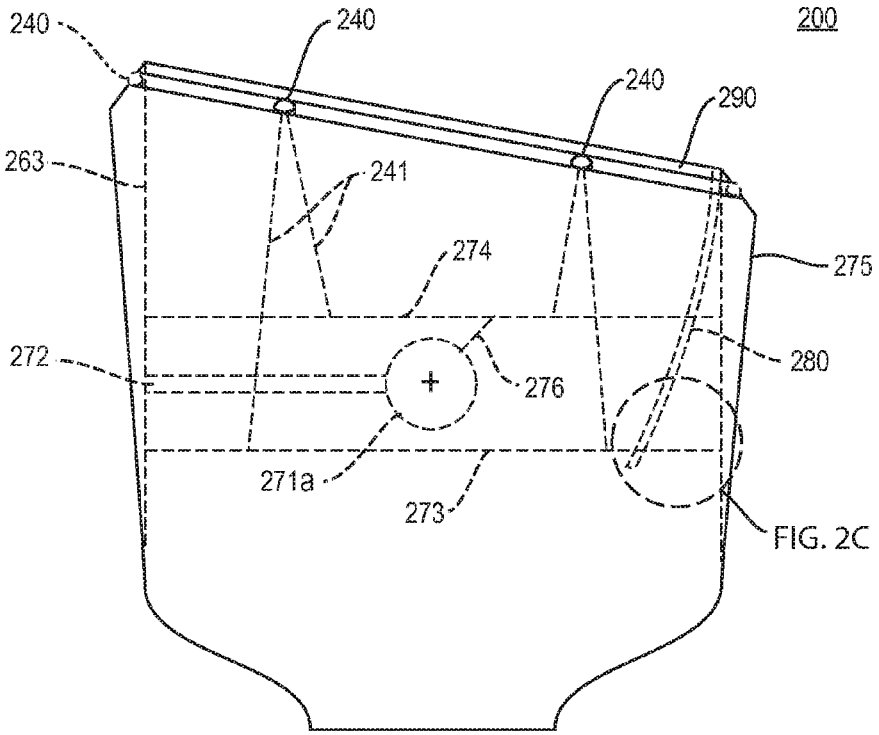
FIG. 2A illustrates the front-side view of an angled and tapered portable light apparatus showing internal electrical circuitry.
Figure 2B:
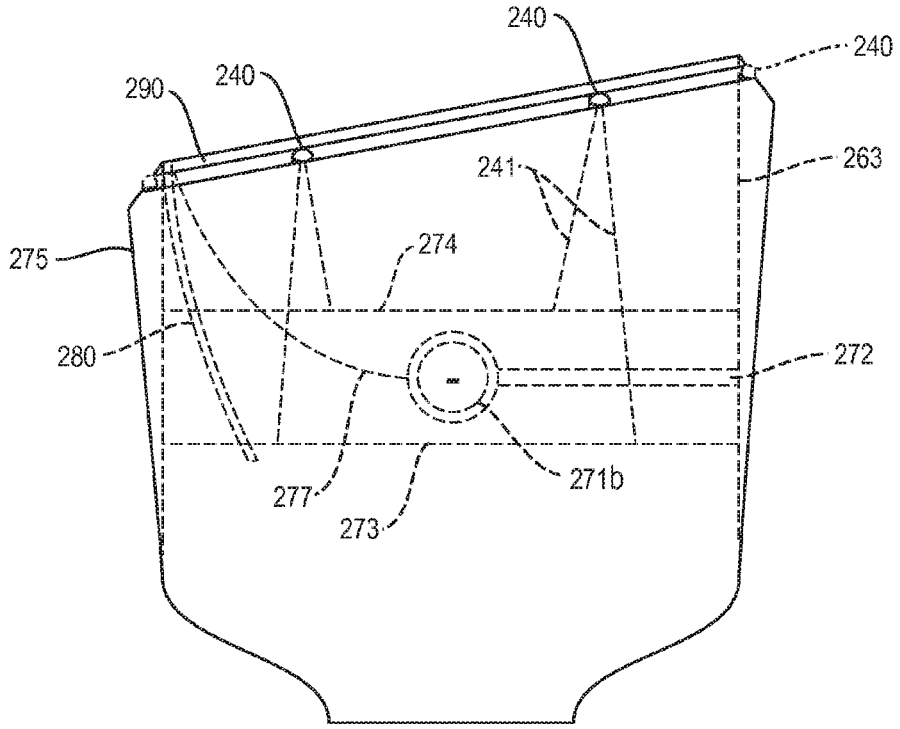
FIG. 2B illustrates the back-side view of an angled and tapered portable light apparatus showing internal electrical circuitry.
Figure 2C:
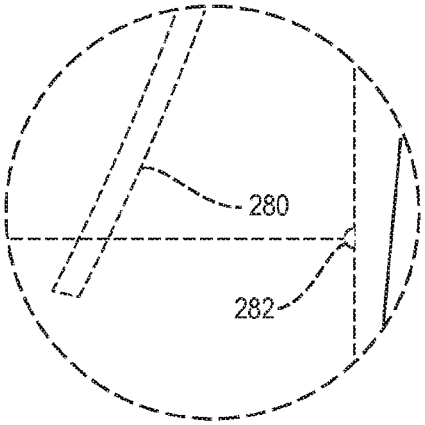
FIG. 2C illustrates an enlarged portion of FIG. 2A showing an electrical contact switch.

FIG. 2A illustrates the front view of the electrical assembly of illuminating apparatus 200. In the embodiment shown, apparatus 200 includes a batteries 271*a-b*, grounding strap 272, conductive tab 280, luminaires 240 with lead wires 241, positive line 274, negative line 273, internal wall 263 of the internal channel 262, tapered side 275, and reflective surface 290. The internal components shown are illustrated in dashed lines except for some of the luminaires 240, which are shown dashed to represent optional luminaires.

Conductive tab 280 is shown extending inwardly into the internal cavity 262 and in an 'open' position causing a break in the electrical circuit which provides power from the batteries 271*a-b* to the luminaires 240. This conductive tab 280 acts as a switch for the system and is configured to complete the electrical circuit automatically when a brush is inserted into the internal channel 262 of 200. This connection (or electrical switch) is made clearer in FIG. 2C when conductive tab 280 connects with electrical contact 282. With the circuit completed energy flows from the batteries into each luminaire causing them to emit light and illuminate the bristles and desired surface area that is to be worked on. Electrical contact 280 is connected with the negative line 273. As shown on the back view of 200 in FIG. 2B a negative line 277 comes off the negative side of 271*b* and connects to the conductive tab 280, which then completes the circuit at electrical contact point 280. Ground strap 272 connects the negative side of 271*a* with the positive side of 271*b*. Positive line 276 extends from the positive side of 271*a* to positive line 274. Each of the leads 241 from luminaires 240 connects one lead to positive line 274 and the other lead to negative line 273.

In one configuration batteries 271*a-b* are 3V lithium batteries electrically stacked to form 6 Volts. Other types of batteries may be used and are within the scope of this invention. This includes using a single battery, multiple batteries, other capacitive sources, solar cells connected to a capacitive source and so forth. The switch shown in FIGS. 2A-E, though situated inside the internal channel, may also be a rotating, push-button, sliding or other type of on/off switch positioned on the outside surface of 200. These additional types of switches are generally more manual in nature and would not be automatically triggered to complete the circuit when a brush is inserted into the internal channel of 200. Instead they would need to be manually slid, rotated, pushed or flipped to complete the circuit.

Figure 2E:
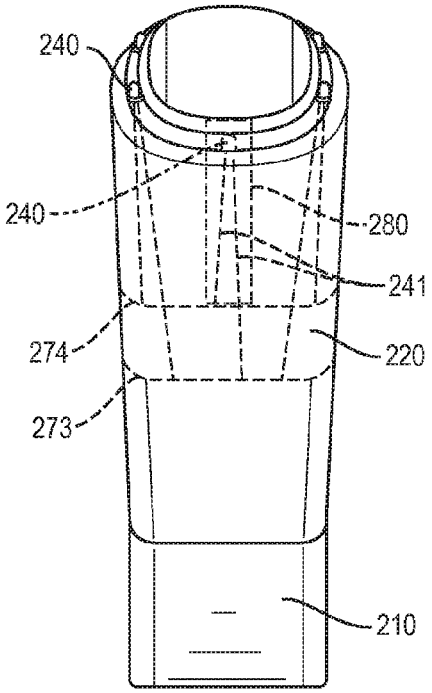
FIG. 2E shows a right-side view of the portable light apparatus of FIG. 2A.
Figure 2D:
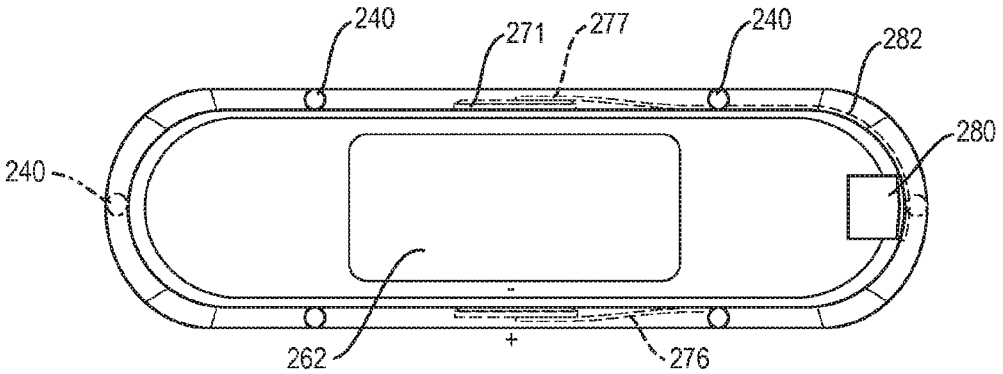
FIG. 2D shows a top view of the portable light apparatus of FIG. 2A.

FIG. 2D illustrates a top view of 200 showing placement of luminaires 240 with optional placement on the right and left sides of the figure as well. Internal channel 262 is shown with rounded openings on both the proximal and distal ends of 200. Also shown is negative line 277 connecting to conductive tab 280 and positive line 276 leading to the other positive line 274 (not shown). The side view illustration shown in FIG. 2E further illustrates how positive line 274 and negative line 273 wrap internally around the body 220 of 200. Contoured portion 210 illustrates a contoured portion forming to the handle portion of a brush. In addition, FIG. 2E illustrates looking into a portion of the angled opening extending into internal channel 262.

In another configuration (not shown) it is contemplated the multiple electrical contacts may reside in the internal channel. Some brushes have a conductive metal ferrule that when slid into the internal channel could also act as a mechanism to complete the switch or electrical circuit providing power from the battery to the luminaires. However, not every brush has a metal ferrule, wherein a conductive tab that is pressed against an electrical contact point inside the internal channel is needed to complete the circuit when a brush is inserted into the internal channel.

Tapered edges 275 are shown in FIGS. 2A, B and E. These tapered edges extend upward to the distal end and help to form a cavity within the body 220 where luminaires, wires and power sources may be contained in. The tapered edges 275 meet up with the beveled edge where the luminaires emit light from. Similarly to FIG. 1 (but not labeled) a transparent window over the cavity portion containing the luminaires helps to form the beveled edge connecting to the tapered edge 275. Portable illuminating apparatus 200 again illustrates another of multiple body types that may be used.

Figure 3:
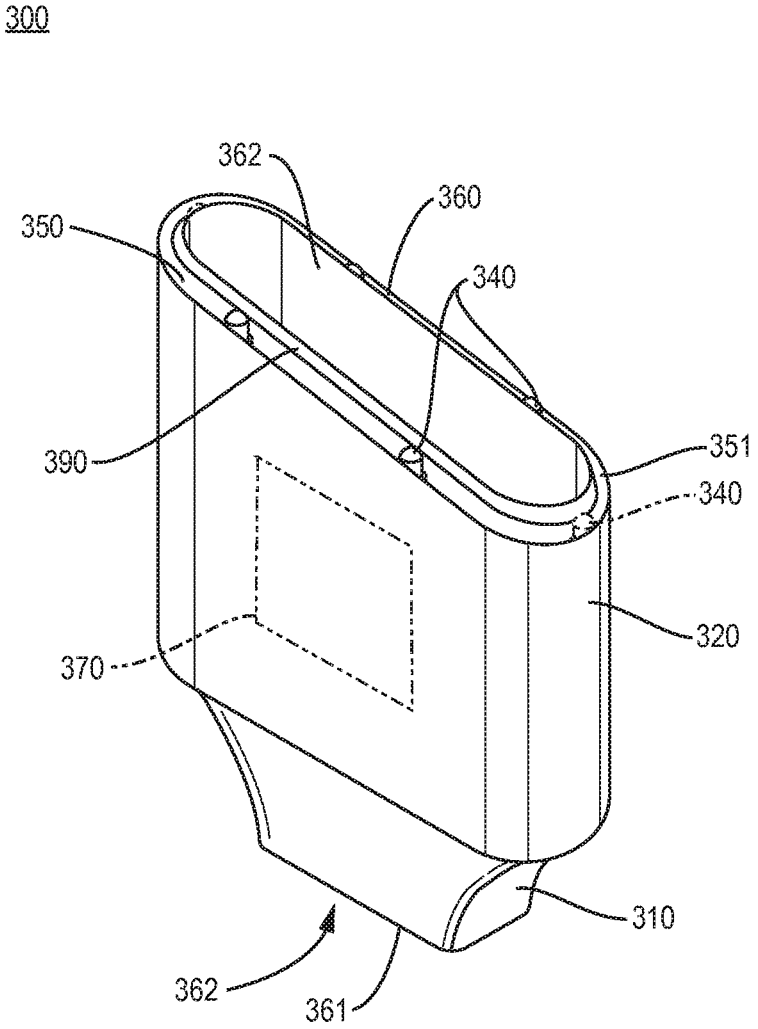
FIG. 3 illustrates a perspective view of an angled and non-tapered portable light apparatus.

The portable illuminating devices described herein may be designed to match the shape and style of any type of paintbrush, other brush, or similar device and may vary in size. Another example of an angled opening portable illuminating apparatus 300 is shown in FIG. 3. The distal opening 360 resides in a plane that is angled with respect to the proximal opening 361 (as opposed to being parallel or substantially parallel in FIG. 1). Other components and parts in FIG. 3 correspond to the labeled parts in FIG. 1 i.e. 310, 320, 340, 350, 351, 361, 362, and 390, correspond to 110, 120, 140, 150, 151, 161, 162, and 190. The choice of using an angled opening as opposed to a horizontal opening depends on the type of brush used e.g. an angled brush versus a flat top brush. This angled opening may range with respect to the same angles used with various brushes.

Figure 4A:
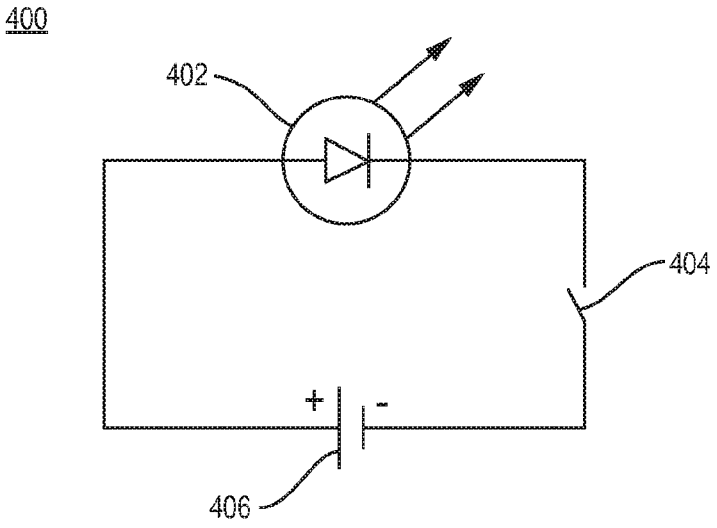
FIGS. 4A-B illustrate electrical schematics for powering luminaires.
Figure 4B:
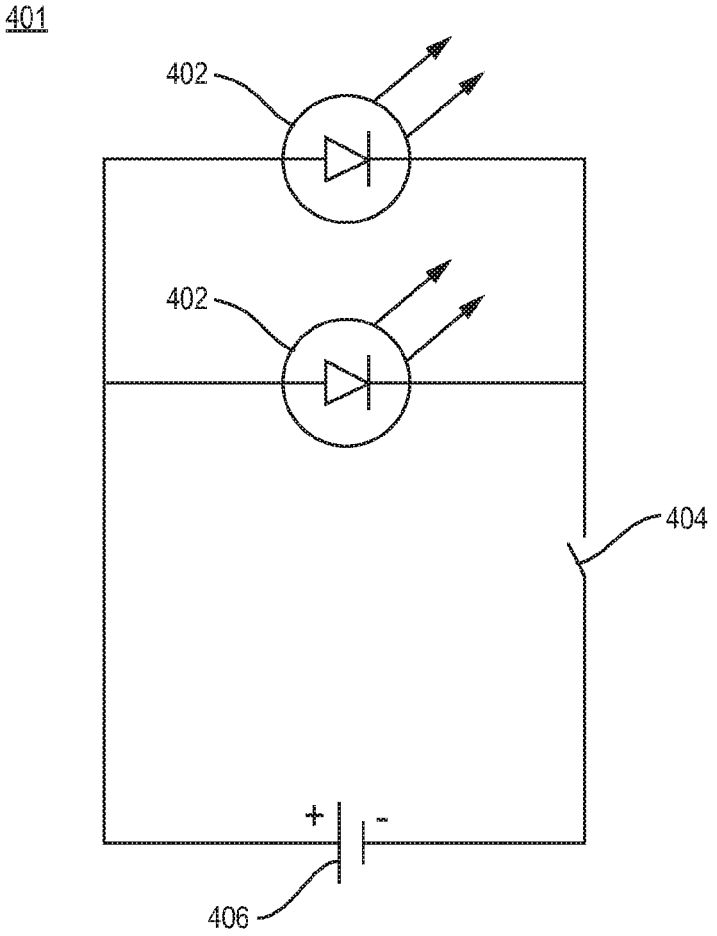

FIGS. 4A-B illustrate various electrical schematics that can be used with the portable illumination devices described herein. A power source 406, such as a battery, is connected to a photodiode 402 (or other luminaire type) with a switch 404 configured to complete or break the circuit sending power from the power source to the photodiode. FIG. 4B illustrates multiple photodiodes 402 shown in parallel. Not shown, but contemplated are photodiodes running in series. The various electrical schematics discussed are by way of example and one skilled in the art would appreciate alternative electrical schematics to be used in conjunction with the systems described herein.

While several embodiments have been described herein that are exemplary of the present invention, one skilled in the art will recognize additional embodiments within the spirit and scope of the invention.

What is claimed is:

1. A portable illumination apparatus comprising:

a body having a proximal end and a distal end, the body containing a channel extending from the proximal end to the distal end of the body, wherein the channel is configured to receive and slide down over a handle of a brush, the channel configured to completely form-fit a ferrule of the brush;

an electrically-conductive tab positioned on an inner surface of the channel and extending into the channel;

an electrical contact point positioned on the inner surface of the channel;

a plurality of luminaires positioned along the distal end of the body;

at least one power source located within the body that is configured to power the luminaires; wherein the ferrule compresses the electrically-conductive tab onto the electrical contact point and completes a circuit.

2. The portable illumination apparatus of claim 1, wherein a portion of the body adjacent to the luminaires is reflective.

3. The portable illumination apparatus of claim 2, wherein the reflective portion is configured to direct light towards a bristle portion of an attached brush.

4. The portable illumination apparatus of claim 2, wherein the reflective portion is configured to direct light away from a bristle portion of an attached brush.

5. A method for illuminating an area around a brush, comprising:

slidably attaching a portable illumination apparatus over a portion of a brush, wherein the portable illumination apparatus is comprised of:

a body having a proximal end and a distal end, the body containing a channel extending from the proximal end to the distal end of the body, wherein the channel is configured to receive a portion of a ferrule of the brush and slidably attach to a brush, wherein the ferrule is substantially encased by the body, a plurality of luminaires positioned along the distal end of the body, an electrically conductive tab extending into the channel, an electrical contact point, positioned on an inner surface of the channel, wherein the conductive tab and contact point together form an electrical switch, and at least one power source located within the body that is configured to power the luminaires; and actuating the conductive tab to engage the contact point to complete an electrical circuit that transfers power from the power source into each luminaire.

6. The method of claim 5, wherein actuating the conductive tab automatically occurs when the portable illumination apparatus slides over the brush.

7. The method of claim 5, wherein the luminaires illuminate a working surface area.

8. A portable illumination apparatus comprising:

a body having a proximal end and a distal end, the body containing a channel extending from the proximal end to the distal end of the body, the channel being configured to receive and slidably attach to a brush, the channel configured to receive a portion of a ferrule of the brush, wherein the ferrule is substantially encased by the body, the body form fitted for the brush;

a plurality of luminaires attached to the body, the luminaires being aimed to provide a cone of light directly to bristles of the brush and to at least two sides of a brush;

at least one power source located within the body;

an electrical conductive tab positioned on an inner surface of the channel and extending into the body; and an electrical contact point, positioned on the inner surface of the channel, wherein the electrical conductive tab is configured to automatically connect to the electrical contact point contained in the channel when the brush is inserted into the channel.

9. The portable illumination apparatus of claim 8, further including a cavity portion formed on the distal end of the body configured to contain the luminaires.

10. The portable illumination apparatus of claim 9, further including a window formed over the cavity.

11. The portable illumination apparatus of claim 10, wherein the window is a lens.

12. The portable illumination apparatus of claim 8, further comprising a reflective surface attached to an outer surface along the distal end of the apparatus between the luminaires and the body.

13. The portable illumination apparatus of claim 8, wherein the reflective surface is configured to direct light towards a bristle portion of a brush.

14. The portable illumination apparatus of claim 8, wherein the reflective surface is configured to direct light away from a bristle portion of a brush.

15. The portable illumination apparatus of claim 8, wherein the distal end of the body is configured to form a cavity large enough to house a luminaire, wherein at least a portion of the cavity is a reflective surface and directs a cone of light toward a bristle portion of a brush.

16. The portable illumination apparatus of claim 15, further comprising a cover that forms over the cavity and is removably attached to the distal end of the body.

17. The portable illumination apparatus of claim 16, wherein the cover is a lens.

18. The portable illumination apparatus of claim 8 wherein the channel configured to receive a portion of the ferrule including form fitting to protrusions on the ferrule of the brush.

* * * * *